United States Patent [19]

Lo

[11] 4,232,539

[45] Nov. 11, 1980

[54] LOCK BODY WITH LOCK PLATES OPENED OR CLOSED BY A CYLINDRICAL KEY BAR

[76] Inventor: Jiuan P. Lo, 30-1, La. 325, St. Tong Ho, Taipei, Taiwan

[21] Appl. No.: 876,042

[22] Filed: Feb. 8, 1978

[51] Int. Cl.[2] ..... E05B 19/08; E05B 29/06

[52] U.S. Cl. ..... 70/364 R; 70/409

[58] Field of Search ..... 70/358, 364 R, 364 A, 70/376–378, 403, 409, 419

[56] References Cited

U.S. PATENT DOCUMENTS 1,635,724 7/1927 Morris ..... 70/403

FOREIGN PATENT DOCUMENTS 716796 8/1965 Canada ..... 70/403

*Primary Examiner*—Robert L. Wolfe

*Attorney, Agent, or Firm*—Cushman, Darby & Cushman

[57] ABSTRACT

A lock with plate-shaped tumblers opened or closed by a cylindrical key bar composed of a cylindrical key bar having annular extending grooves corresponding to the tumblers, cylindrical plug, lock body, protecting ring, protecting plate and several plate-shaped tumblers having square or oval holes therethrough arranged in single row, double rows or cross rows. The tumblers are arranged within the plug by single row, double row or cross row. When the lock is in the closed state, the tumblers are spring biased into a first set of obstructing grooves in the lock body. When the key bar is first inserted into the lock through the tumbler holes, the tumblers are pushed into a second set of grooves in the lock opposing the first set. When the key is turned, the tumblers fall into the corresponding grooves and upon further turning the sides of the grooves engage the tumblers turning the plug and opening the lock.

9 Claims, 11 Drawing Figures

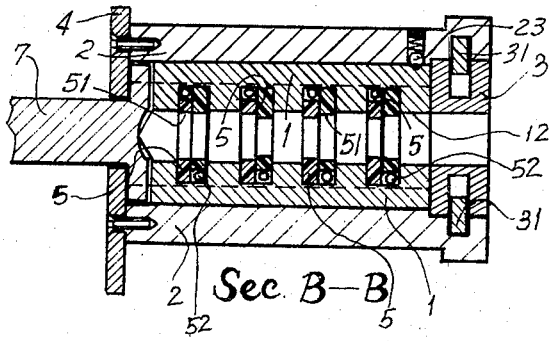
Fig. 1
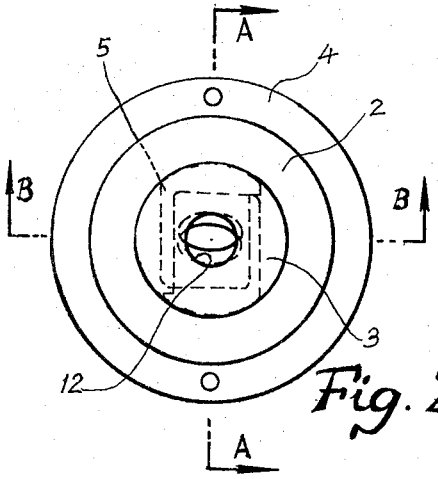
Fig. 2
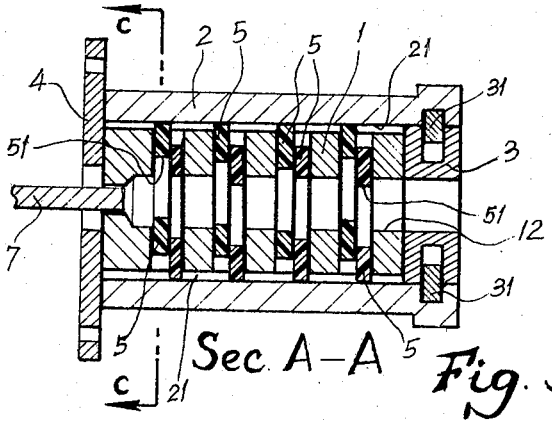
Fig. 3
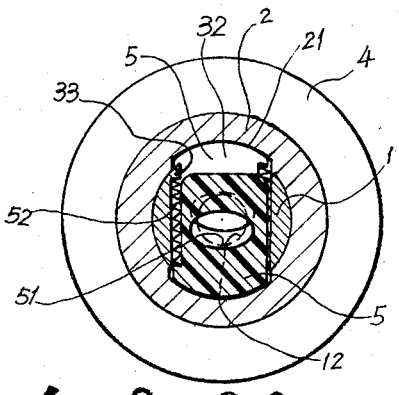
Fig. 4 Sec. C–C (I)
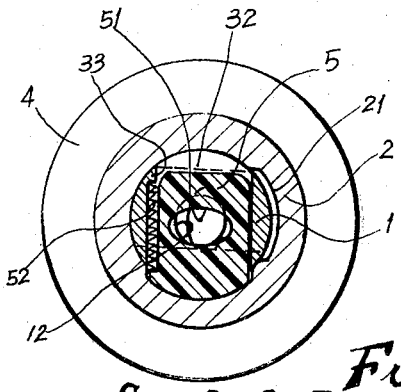
Sec. C–C (II) Fig. 5
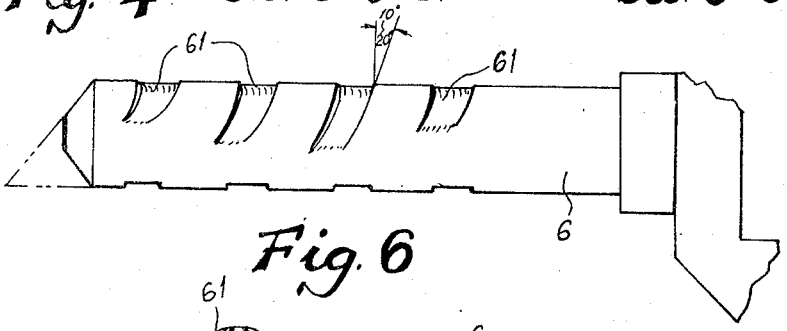
Fig. 6
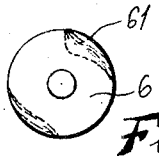
Fig. 7a
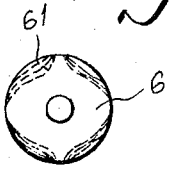
Fig. 7b
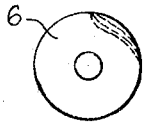
Fig. 7c
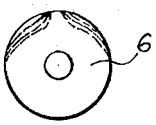
Fig. 7d

LOCK BODY WITH LOCK PLATES OPENED OR CLOSED BY A CYLINDRICAL KEY BAR

BACKGROUNDS OF THE INVENTION

The conventional lock may be opened by a thief by using the conventional mechanical method or tool such as to find out the forcible point in the lock and to search for a suitable key to actuate the forcible point and open the lock. The usual key is made with flat plate and will thus be easily imitated for opening the lock. The present inventor has found this defect and improved upon the conventional lock by increasing the complexity and safety over the conventional lock.

SUMMARY OF THE INVENTION

The present invention relates to a lock with plate-shaped tumblers (locking plates) opened or closed by a cylindrical key bar. The lock is composed of cylindrical key bar, protecting ring, cylindrical plug (lock core), lock body, protecting plate and several rows of locking plates having square or oval holes therethrough which are pressurized by the springs connecting said locking plates and said lock core.

The object of the present invention is to provide a lock means by which a cylindrical key bar may be inserted into said lock core and the key grooves on said key bar will control the locking plates to engage with the obstructing grooves on said lock body for locking use or release the locking plates from said lock body for opening said lock.

Said locking plates may be arranged in single row or double rows within said lock core. When arranging in double rows, they can be arranged in cross-row arrangement or in linear arrangement. (one row is opposite to the other)

BRIEF DESCRIPTION OF THE DRAWINGS

FIG. 1 is the sectional drawing of the present invention.

FIG. 2 is the side view drawing of the present invention.

FIG. 3 is the A—A sectional drawing of the present invention.

FIG. 4 is the allocation drawing of the locking plates of the present invention (Two rows arrangement, linear but opposite with each other)

FIG. 5 is the allocation drawing of the locking plates with crow-row arrangement.

FIG. 6 is the drawing of said cylindrical key bar of the present invention.

FIG. 7 is the sectional drawing of said cylindrical key bar (a-d).

DESCRIPTION OF THE PREFERRED EMBODIMENT

Figure 8:
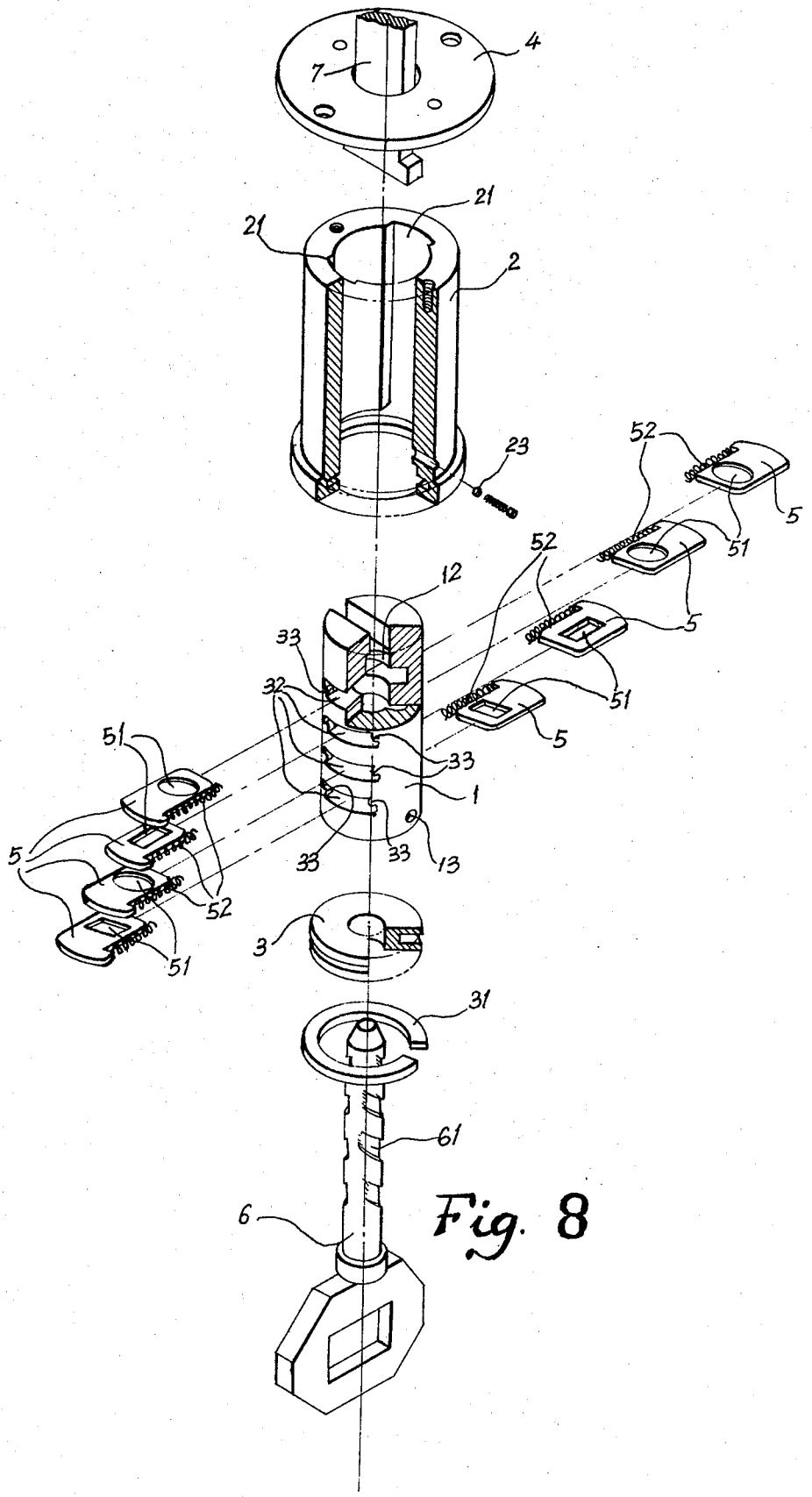
FIG. 8 is the parts perspective drawing of the present invention.

As shown in FIG. 1, the cylindrical plug (lock core) 1 of the present invention may drive the roll-back (lock tongue) 7 for opening the lock. Said lock core 1 is hidden and fixed by protecting ring 3 and protecting plate 4. Protecting ring 3 is fixed onto the front portion of said lock body 2 by a retention ring 31, lock body 2 having a larger diameter at its front portion. Said retention ring 31 is inserted between said lock body 2 and protecting ring 3 for permanent fixation and protecting said lock core 1 from being stolen.

Said protecting plate 4 serves to protect said lock core 1 from being damaged and to fix the present lock body onto any supporting frame or material.

As shown in FIGS. 2 and 3, said lock core 1 is provided with one row or several rows of opening (tunnels) 32 for passing tumblers (locking plates) 5. Each tunnel 32 is provided with two recessed brackets 33 allocated on both ends of said tunnel.

The spring 52 provided within recessed bracket 33 will force said locking plate 5 into one of two obstructing grooves 21 on said lock body 2. The square or oval hole 51 of said locking plate 5 will be slightly and variably deviated from the central line of key hole 12 of the lock core 1. So that the edges of hole 51 abut the non-grooved portion of key bar 6, locking plates will be forced from one groove 21 to the opposing groove 21. Key bar 6 is inserted in hole 12. Key bar 6 has grooves 61 corresponding to each tumbler 5. Each key groove 61 has suitable depth to release the corresponding tumbler 5 back into said lock core 1 and fully out of both obstructing grooves 21 so as to release the lock core 1 from lock body 2. The lock core 1 will then be smoothly rotated to actuate the lock tongue 7 for opening the lock, as will be explained.

When the locking plates 5 are arranged in cross-row, the arrangements of tunnels 32 should be independent and separated so as to enhance the strength of lock core 1 and the stability of each locking plate 5 when pressed by said cylindrical key bar 6.

As shown in FIGS. 6 and 7, said cylindrical key bar 6 may push or retract said locking plate 5 in single direction or double directions.

For single row arrangement, the rotation may be in two directions using key bar 6 shown in FIG. *7c* or one direction using key bar 6 shown in FIG. *7d*. For two rows of locking plates 5, the rotation may also be in one direction if a key bar shown in FIG. *7a* is used, or two directions if a key bar 6 shown in FIG. *7b* is used. Grooves 61 on key bar 6 are extended at an angle which deviates from perpendicular to the longitudinal axis of the key bar 6 by between 10° and 20°. Because of this angle, when locking plates 5 are resting in grooves 61, and the key bar 6 is turned, an angular force will be applied by the sides of grooves 61 to the bottom edges of locking plates 5, thereby causing the locking plates and lock core 1 to rotate. Lock tongue 7, being mounted along the rear end surface of lock core 1 for rotation with lock core 1, will also rotate.

As shown in FIG. 8, an engaging hole 13 is provided on said lock core 1 and an abrupted steel ball 23 is provided on said lock body 2. When releasing the locking plate 5 from the obstructing grooves 21 and trying to re-lock said lock, said cylindrical key bar 6, may be rotated to carry the lock core and to engage the abrupted steel ball 23 with the engaging hole 13 in order to indicate said locking plate 5 have reached their correct positions cylindrical key bar 6 may then be pulled out and allow the spring 51 will push each of said plates 5 into one of the obstructing grooves 21 of lock body 2 so as to close the lock.

In arranging the locking plates 5, each row can be provided with 3 through 12 plates. Every locking plate 5 of each row can be optionally moved either rightward or leftward for variable arrangement. This will diversify the lock structure and make it more complex. The key hole 12 and protecting ring 3 are made in circular shape without any forcible point to prevent thefts. The lock would not be easily damaged or opened by the thief.

The square or oval hole 52 of the present locking plate 5 is well designed for easy and smooth insertion of said cylindrical key bar 6.

The present lock body means may be modified without departing from the spirit and scope in accordance with the present invention.

I claim:

1. A cylindrical lock comprising:

a housing;

a cylindrical plug mounted for rotation in said housing;

a roll-back mounted for rotation with said plug;

tumbler means disposed in said plug for opening and closing said lock, said tumbler means including a plurality of plate-shaped tumblers disposed in said plug;

cylindrical key bar means for aligning said plurality of tumblers at the periphery of said plug;

said bar means including a cylindrical bar having angled grooves in the periphery thereof each of said tumblers corresponding to one of said plurality of grooves;

each of said plurality of tumblers being responsive to pressure applied by one of the sides of said corresponding groove when said key bar means are rotated in said plug, to rotate said plug and said roll-back.

2. A cylindrical lock comprising:

a housing;

a cylindrical plug mounted for rotation in said housing;

a roll-back mounted for rotation with said plug;

tumbler means disposed in said plug for opening and closing said lock; said tumbler means including a plurality of spring biased plate-shaped tumblers disposed in said plug having holes therethrough, having peripheral ends and having actuation portions with diversified lengths adjacent said holes;

cylindrical key bar means, disposable through said holes in said plurality of tumblers, for aligning said peripheral ends of said plurality of tumblers at the periphery of said plug;

said bar means including a cylindrical bar having a plurality of angled grooves in the periphery thereof, the actuation portion of each of said plurality of tumblers corresponding to one of said plurality of grooves;

each of said plurality of tumblers being responsive to pressure applied by the sides of said corresponding groove to said tumbler actuation portion when said key bar means are rotated in said plug to rotate said plug and said roll-back.

3. A cylindrical lock comprising:

a housing;

a cylindrical plug mounted for rotation in said housing;

a roll-back mounted for rotation with said plug;

tumbler means disposed in said plug for opening and closing said lock; said tumbler means including a plurality of spring biased plate-shaped tumblers disposed in said plug for radial motion relative to said plug having holes therethrough, having peripheral ends and having actuation portions with diversified lengths adjacent said holes; said peripheral ends being extendable beyond the periphery of said plug for closing said lock;

cylindrical key bar means, disposable through said holes in said plurality of tumblers, for aligning said peripheral ends of said plurality of tumblers at the periphery of said plug;

said bar means including a cylindrical bar having a plurality of grooves in the periphery thereof, the actuation portion of each of said plurality of tumblers corresponding to one of said plurality of grooves.

4. A cylinder lock comprising:

a housing;

a rotationally mounted cylindrical plug within said housing, said plug having a front surface and a peripheral surface;

said housing having a surface with a first plurality of indentations adjacent the periphery of said plug;

said cylindrical plug periphery having a first plurality of openings extending radially therein, each of said first plurality of openings corresponding to one of said first plurality of indentations and radially aligned therewith;

biased tumbler means, disposed in each of said first plurality of openings and extendable into said corresponding first plurality of indentations for locking said plug against rotation;

said tumbler means including a plurality of tumblers having inner and peripheral ends, and having actuation portions of diversified length disposed in said first plurality of openings;

a cylindrical key bar slidably insertable in said plug through said front end, said bar having a plurality of grooves in the periphery thereof, each of said first plurality of tumblers corresponding to one of said plurality of grooves;

each of said plurality of grooves having a depth corresponding to the length of the actuation portion of said corresponding tumbler;

each of said plurality of grooves being arranged to receive therein said corresponding tumbler inner end;

each said corresponding tumbler peripheral end is aligned relative to said periphery of said plug by said plurality of grooves to release said plug for rotation, each of said plurality of grooves extending non-perpendicularly to the longitudinal axis of said key bar and having an actuation point along one side surface thereof, such that said corresponding tumbler peripheral end will be pressed against said one side surface at said actuation point of said one of said plurality of grooves when said key bar is turned.

5. A cylinder lock as in claim 4 wherein each of said plurality of tumblers comprises a plate having a hole therethrough adapted for receiving said key bar, each plate having a back portion, said hole being disposed between said back portion and said actuation portion, said inner end disposed between said back portion and said actuation portion; and said housing having a second plurality of indentations;

said plug periphery having a second plurality of openings extending radially therein; each of said second plurality of openings being directly opposed by one of said first plurality of openings, each said plate back portion being disposed in one of said second plurality of openings and extendable into one of said plurality of indentations.

6. A cylinder lock as in claim 3 wherein each of said plates has a back portion, said hole being disposed between said back portion and said actuation portion, said inner end disposed between said back portion and said actuation portion; said housing having a first and a second plurality of indentations; and said plug periphery having a first and a second plurality of openings extending radially into said plug; each of said second plurality of openings being directly opposed by one of said first plurality of openings, each said actuation portion being disposed in one of said first plurality of openings and extendable into one of said first plurality of indentations, each said plate back portion being disposed in one of said second plurality of openings and extendable into one of said second plurality of indentations.

7. A cylinder lock as in claim 4 or claim 6, wherein said first and second pluralities of plug openings and said first and second pluralities of housing indentations are aligned in rows parallel to the longitudinal axis of said plug; and said key bar grooves are aligned in one or more rows parallel to the longitudinal axis of said key bar; said rows of indentations forming continuous grooves in said housing.

8. A cylinder lock as in claim 1 or claim 4, wherein each of said plurality of key bar grooves is extended at angles to the longitudinal axis of said key bar of between 10° and 20°.

9. A cylinder lock as in claim 7, wherein said plurality of grooves are arranged with two rows of grooves for each row of plug openings so that said lock may be opened or closed by rotation of said key bar in either direction.

* * * * *